US007317804B2

(12) United States Patent
Kinoshita

(10) Patent No.: US 7,317,804 B2
(45) Date of Patent: Jan. 8, 2008

(54) SOUND COLLECTING DEVICE MINIMIZING ELECTRICAL NOISE

(75) Inventor: Hidetoshi Kinoshita, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 71 days.

(21) Appl. No.: 11/127,258

(22) Filed: May 12, 2005

(65) Prior Publication Data

US 2005/0259837 A1 Nov. 24, 2005

Related U.S. Application Data

(62) Division of application No. 09/412,647, filed on Oct. 5, 1999, now Pat. No. 6,975,735.

(30) Foreign Application Priority Data

Oct. 5, 1998 (JP) ..... 10-282720

(51) Int. Cl.
*H04R 25/00* (2006.01)
*H04R 3/00* (2006.01)

(52) U.S. Cl. ..... 381/163; 381/162; 381/91; 381/122

(58) Field of Classification Search ..... 381/163, 381/92, 91, 122, 162, 164
See application file for complete search history.

(56) References Cited

U.S. PATENT DOCUMENTS 3,798,374 A * 3/1974 Meyers ..... 381/96
4,199,721 A 4/1980 Ono et al.
4,317,009 A 2/1982 Shintaku
4,404,541 A 9/1983 Kodera
4,589,137 A * 5/1986 Miller ..... 381/94.2
4,833,660 A 5/1989 Deom et al.
4,891,628 A 1/1990 Zuckerman
4,891,796 A 1/1990 Sekine
4,937,796 A 6/1990 Tendlet
5,037,189 A 8/1991 Fuji et al.
5,059,946 A 10/1991 Hollowbush
5,131,047 A 7/1992 Hashimoto et al.
5,173,881 A 12/1992 Sindle
5,193,117 A * 3/1993 Ono et al. ..... 381/92
5,243,661 A * 9/1993 Ohkubo et al. ..... 381/94.2
5,400,409 A 3/1995 Linhard (Continued)

FOREIGN PATENT DOCUMENTS

FR 2724015 * 3/1996

(Continued)

*Primary Examiner*—Xu Mei
(74) *Attorney, Agent, or Firm*—Connolly Bove Lodge & Hutz LLP

(57) ABSTRACT

A sound collecting device is provided which is designed to minimize adverse effects on an output caused by exposure of an electroacoustic transducer to the air. The device includes an electroacoustic transducer and a vibrating circuit. The transducer is exposed to the air and responsive to input of a sound wave to produce a corresponding acoustic signal. The vibrating circuit vibrates the transducer to shake foreign substances such as dust or drops of water from the transducer. In a modified form, an electromagnetic sensor is provided which measures an electromagnetic noise transmitted to the transducer and which removes the electromagnetic noise from an output of the transducer to produce a noiseless acoustic signal.

8 Claims, 5 Drawing Sheets

U.S. PATENT DOCUMENTS 5,471,538 A * 11/1995 Sasaki et al. ..... 381/92
5,500,903 A 3/1996 Gulli
5,673,325 A 9/1997 Andrea et al.
5,675,655 A 10/1997 Hatae
5,784,241 A * 7/1998 Munch et al. ..... 361/111
5,844,471 A 12/1998 Daniel
6,587,568 B1 * 7/2003 Sigwanz ..... 381/317

FOREIGN PATENT DOCUMENTS

JP 57-166696 10/1982
JP 5-22787 1/1993
JP 9-167977 6/1997

* cited by examiner

SOUND COLLECTING DEVICE MINIMIZING ELECTRICAL NOISE

This application is a Divisional of application Ser. No. 09/412,647, filed on Oct. 5, 1999, now U.S. Pat. No. 6,975,735 and for which priority is claimed under 35 U.S.C. § 120; and this application claims priority of Application No. 10-282720 filed in Japan on Oct. 5, 1998 under 35 U.S.C. § 119; the entire contents of all are hereby incorporated by reference

BACKGROUND OF THE INVENTION

1. Technical Field of the Invention

The present invention relates generally to a sound collecting device designed to minimize electric noises caused by dust, frozen foreign substances lying on an electroacoustic transducer exposed to the air, or electromagnetic noises inputted directly to the transducer.

2. Background Art

FIG. 8 shows a conventional sound collecting device which consists of a horn 1 designed so as to increase in sectional area in a lengthwise direction for ease of collecting the sound wave, an electroacoustic transducer 2 (i.e., a microphone) installed in a base of the horn 1, and a preamplifier 3 connecting electrically with the transducer 2. An audio signal outputted from the transducer 2 is, as clearly shown in FIG. 9, amplified by the preamplifier 3 and outputted to an external device.

The transducer 2 is usually exposed to the air for catching sound waves and thus has the problems in that dust is gathered on a diaphragm of the transducer 2 with time or when the device is used in winter, it may cause the moisture in the air to be frozen solid on the diaphragm, which affects on an operation of the transducer 2, and in that since the transducer 2 needs to be exposed directly to the air, it is difficult to use a shield for protecting the transducer 2 from electromagnetic waves originating from high-voltage cables or transmission antennas, so that the electromagnetic noises are inputted directly to the transducer 2.

SUMMARY OF THE INVENTION

It is therefore a principal object of the present invention to avoid the disadvantages of the prior art.

It is another object of the present invention to provide a sound collecting device designed to minimize adverse effects on an output caused by dust, frozen foreign substances lying on an electroacoustic transducer exposed to the air, or electromagnetic noises inputted directly to the transducer.

According to one aspect of the invention, there is provided a sound collecting device which comprises: (a) a transducer responsive to input of a sound wave to vibrate, producing a corresponding acoustic signal; (b) an amplifier amplifying the acoustic signal from the transducer; and (c) a vibrating circuit connected to the transducer in parallel to the amplifier to vibrate the transducer.

In the preferred mode of the invention, a switch is provided which selectively establishes and blocks communications between the transducer and the amplifier and between the transducer and the vibrating circuit.

A controller is provided which controls an operation of the vibrating circuit. The controller may also control a switching operation of the switch.

A temperature sensor is provided which measures an ambient temperature. The controller controls the vibrating circuit to vibrate the transducer at a shorter time interval when the ambient temperature measured by the temperature sensor is lower than a given value and at a longer time interval when the ambient temperature is higher than a given value.

According to the second aspect of the invention, there is provided a sound collecting device which comprises: (a) a transducer responsive to input of a sound wave to vibrate, producing a corresponding acoustic signal; (b) an amplifier amplifying the acoustic signal from the transducer; (c) an electromagnetic sensor responsive to input of an electromagnetic wave to produce a corresponding electromagnetic signal; (d) and an output circuit subtracting the electromagnetic signal produced by the electromagnetic sensor from an output from the amplifier to produce an acoustic signal from which an electromagnetic wave-caused noise is removed.

In the preferred mode of the invention, a housing, a sound collecting unit disposed within the housing, and a sensor amplifier amplifying the electromagnetic signal outputted from the electromagnetic sensor are provided. The transducer is installed in the sound collecting unit. The electromagnetic sensor is installed in the housing adjacent the sound collecting unit.

An opening formed in the housing for allowing the electromagnetic wave to enter the electromagnetic sensor from the same direction as that in which the sound wave enters the transducer.

A first and a second peak hold circuit are provided. The first peak hold circuit holds a peak of the output from the amplifier to provide a corresponding signal to the output circuit. The second peak hold circuit holds a peak of an output from the sensor amplifier to provide a corresponding signal to the output circuit.

A transducer vibrating circuit is connected to the transducer in parallel to the amplifier to vibrate the transducer. A sensor vibrating circuit is connected to the electromagnetic sensor in parallel to the sensor amplifier to vibrate the electromagnetic sensor.

A first and a second switch are provided. The first switch selectively establishes and blocks communications between the transducer and the amplifier and between the transducer and the transducer vibrating circuit. The second switch selectively establishes and blocks communications between the electromagnetic sensor and the sensor amplifier and between the electromagnetic sensor and the sensor vibrating circuit.

A controller is provided which controls an operation of the transducer vibrating circuit. The controller may also control switching operations of the first and second switches.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 4(*b*) is an ON-signal inputted to a drive circuit;

DESCRIPTION OF THE PREFERRED EMBODIMENTS

Figure 1:
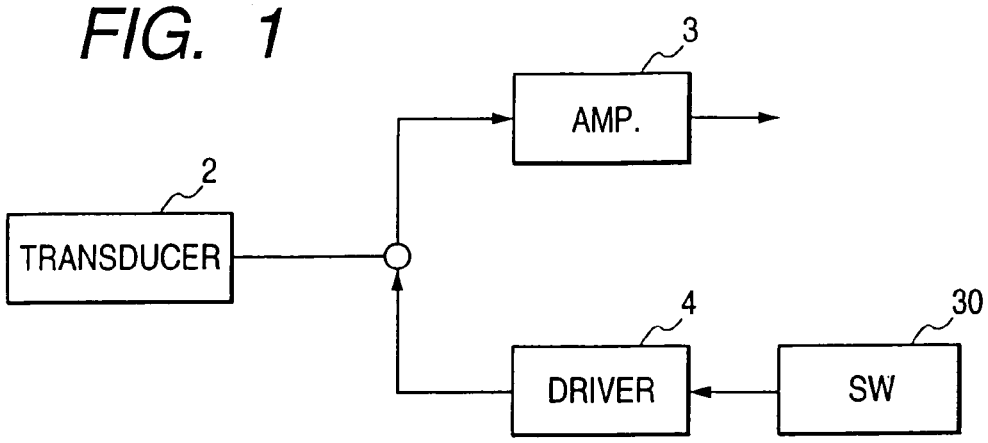
FIG. 1 is a block diagram which shows a sound collecting device according to the first embodiment of the invention.

Referring now to the drawings, wherein like numbers refer to like parts in several views, particularly to FIG. 1, there is shown a sound collecting device according to the first embodiment of the present invention.

Figure 8:
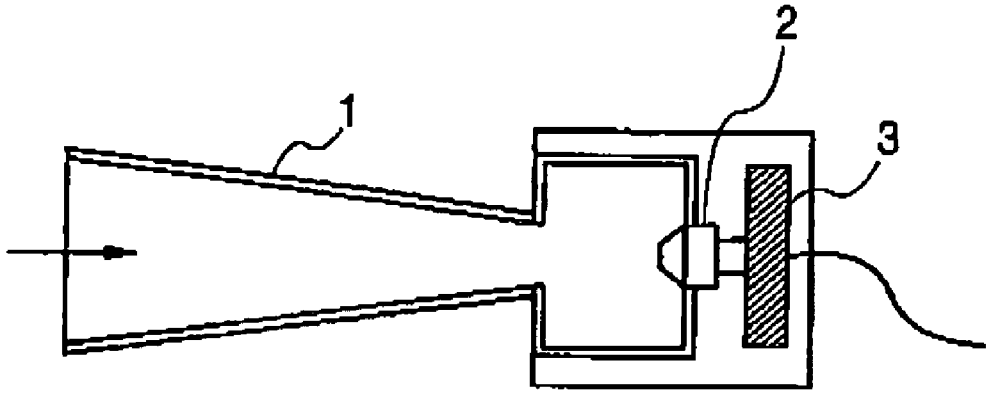
FIG. 8 PRIOR ART
FIG. 8 is a sectional view which shows a conventional sound collecting device.
Figure 9:
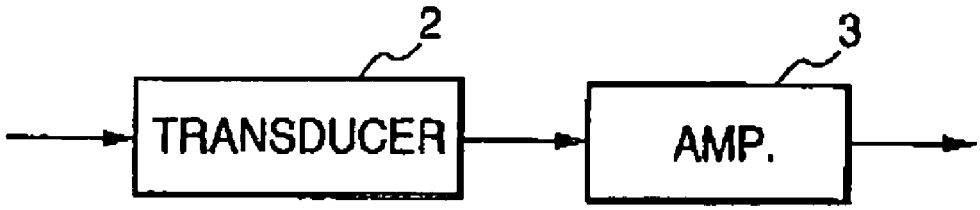
FIG. 9 PRIOR ART
FIG. 9 is a block diagram which shows a circuit structure of the sound collecting device in FIG. 8.

The sound collecting device generally includes an electroacoustic transducer 2 (e.g., a microphone), a preamplifier 3, a drive circuit 4, and a manual switch 30 has substantially the same mechanical structure as that in the conventional one shown in FIG. 8. Specifically, the transducer 2 is installed in a base of a horn such as the one shown in FIG. 8; and designed so as to increase in sectional area in a lengthwise direction for ease of collecting sound waves. The transducer 2 is responsive to the sound waves or sound-producing vibrations applied to, for example, a diaphragm to vibrate to produce corresponding electrical signals and outputs them to the preamplifier 3. The preamplifier 3 amplifies the input signals and outputs them to an external device (not shown). The drive circuit 4 is connected in parallel to the preamplifier 3 which is responsive to an ON-signal outputted from the manual switch 30 turned on by an operator of the device to vibrate the transducer 2 at a given frequency for shaking foreign substances such as dust or drops of water from the diaphragm of the transducer 2. The vibration of the transducer 2 is stopped by manual input of an OFF-signal from the switch 30.

Figure 2:
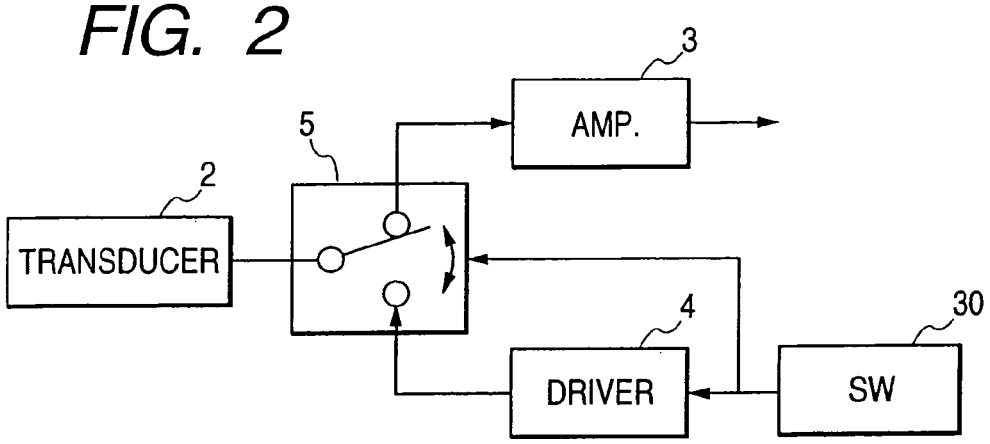
FIG. 2 is a block diagram which shows a sound collecting device according to the second embodiment of the invention.

FIG. 2 shows the second embodiment of the invention which is different from the first embodiment in FIG. 1 only in that a switch 5 is provided which blocks electrical communication between the transducer 2 and the preamplifier 3 in response to input of the ON-signal from the manual switch 30. Other arrangements are identical, and explanation thereof in detail will be omitted here.

The switch 5 is actuated by the operator through the manual switch 30 to selectively establish electrical communications between the transducer 2 and the preamplifier 3 and between the transducer 2 and the drive circuit 4.

In operation, when it is required to collect sound waves, the operator turns off the manual switch 30 to connect the transducer 2 and the preamplifier 3. When it is required to vibrate the transducer 2, the operator turns on the manual switch 30 to input the ON-signals to the switch 5 and the drive circuit 4. The switch 5 then blocks the electrical communication between the transducer 2 and the preamplifier 3 to stop the sound-collecting operation, while it establishes the electrical communication between the transducer 2 and the drive circuit 4 to vibrate the transducer 2 for shaking foreign substances from the transducer 2.

Figure 3:
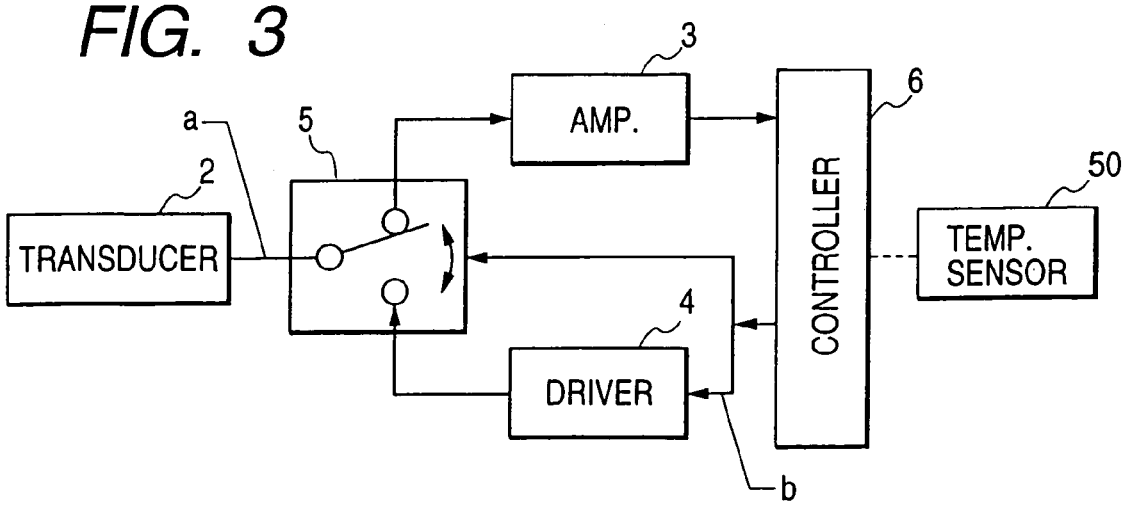
FIG. 3 is a block diagram which shows a sound collecting device according to the third embodiment of the invention.

FIG. 3 shows the third embodiment of the invention which is different from the second embodiment in FIG. 2 in that a controller 6 is provided instead of the manual switch 30. Other arrangements are identical, and explanation thereof in detail will be omitted here.

The controller 6 is designed to output the ON-signals to the drive circuit 4 and the switch 5 automatically upon turning on of the device or in response to input of a control signal from an external device to block the electrical communication between the transducer 2 and the preamplifier 3 while establishing the electrical communication between the transducer 2 and the drive circuit 4 to vibrate the transducer 2.

A temperature sensor 50 may be provided which measures the ambient temperature and outputs a signal indicative thereof to the controller 6. The controller 6 is responsive to the signal from the temperature sensor 50 to output the ON-signals to the drive circuit 4 and the switch 5 selectively. Usually, in cold conditions, the moisture in the air is frozen solid on the transducer 2, which will affect on the operation of the transducer 2. Therefore, when the device is in a cold condition, that is, when the ambient temperature measured by the temperature sensor 50 is less than a given low temperature level, the controller 6 outputs the ON-signals for 2 ms. at intervals of 1 sec. to vibrate the transducer 2. When the device is used at a room temperature, it is required only to remove dust from the transducer 2. Thus, when the ambient temperature measured by the temperature sensor 50 is higher than a given normal temperature level, the controller 6 outputs the ON-signals for 2 ms. at intervals of one hour to vibrate the transducer 2.

Figure 4A:
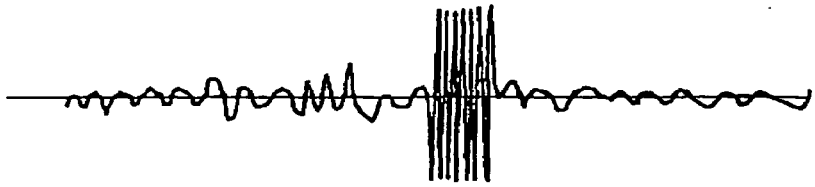
FIG. 4(*a*) is a signal wave outputted from a transducer.
Figure 4B:
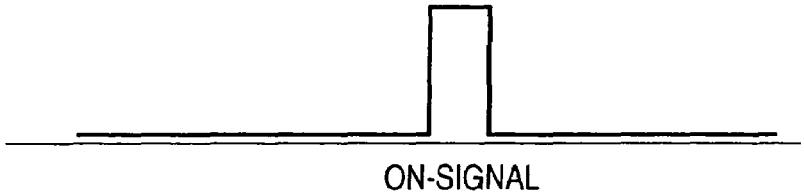

FIG. 4(*b*) shows an ON-duration for which the controller 6 outputs the ON-signals to the drive circuit 4 and the switch 5. FIG. 4(*a*) shows acoustic signals inputted from the transducer 2 to the controller 6 through the preamplifier 3. The controller 6 compares the acoustic signals inputted thereto with a preselected threshold level to remove noise components resulting from the vibration of the transducer 2 produced by the drive circuit 4.

The circuit structure shown in FIG. 3 may be used with the first embodiment shown in FIG. 1.

Figure 5:
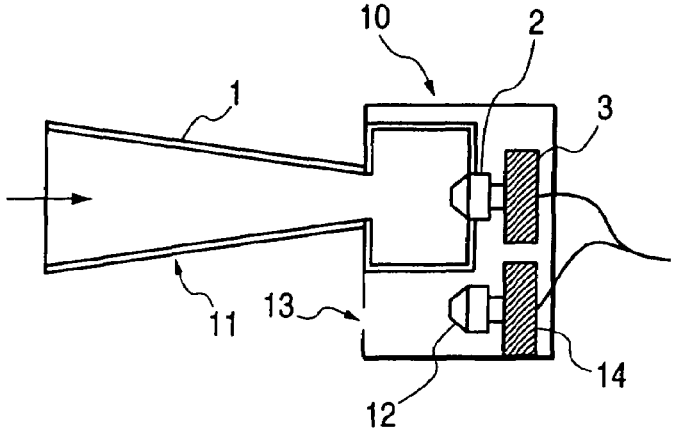
FIG. 5 is a sectional view which shows a sound collecting device according to the fourth embodiment of the invention.

FIG. 5 shows a sound collecting device according to the fourth embodiment of the invention.

The sound collecting device includes generally a housing 10 and a sound collecting unit 11 installed in the housing 10. The sound collecting unit 11 consists of a horn 1 designed so as to increase in sectional area in a lengthwise direction for ease of collecting the sound wave and an electroacoustic transducer 2 installed in a base of the horn 1. A preamplifier 3, like the above embodiments, connects electrically with the transducer 2.

The sound collecting device also includes an electromagnetic sensor 12, an amplifier 14, and a subtractor 15. The electromagnetic sensor 12 is made of a transducer and disposed in the housing 10 to catch electromagnetic waves (i.e., electric noises) inputted through an opening 13 and outputs a signal indicative thereof to the amplifier 14. The opening 13 is formed in the front surface of the housing 10 from which the horn 1 extends so that the electromagnetic sensor 12 can catch the electromagnetic waves transmitted from the same direction as that in which the sound waves enter the transducer 2. The amplifier 14 amplifies the input from the electromagnetic sensor 12 and outputs it to the subtractor 15. The amplifiers 3 and 14 may be omitted when the strength of sound waves and electromagnetic waves inputted to the transducer 2 and the electromagnetic sensor 12 is relatively great.

Figure 6:
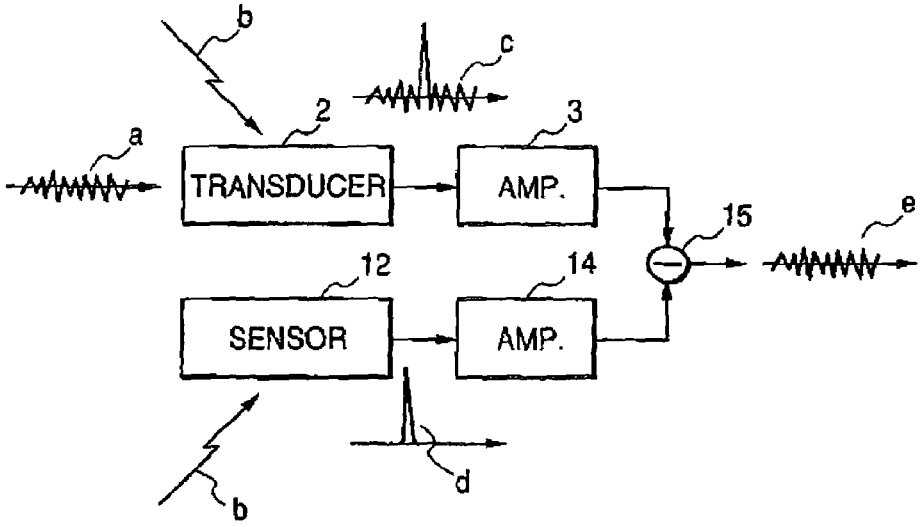
FIG. 6 is a block diagram which shows a circuit structure of the sound collecting device shown in FIG. 5.

In operation, the transducer 2, as shown in FIG. 6, receives both a sound wave a and an electromagnetic wave or noise b, while the electromagnetic sensor 12 receives only the electromagnetic noise b. The transducer 2 outputs a composite signal c that is a mixture of the sound wave a and the electromagnetic wave b to the subtractor 15 through the amplifier 3. The electromagnetic sensor 12 outputs a noise signal d corresponding to the electromagnetic noise b to the subtractor 15 through the amplifier 14. The subtractor 15 removes the noise signal d from the composite signal c to produce an acoustic signal e corresponding to the sound wave a. Therefore, even when used under the influence of electromagnetic waves, the sound collecting device of this embodiment can provide sound signals without electromagnetic noises.

Figure 7:
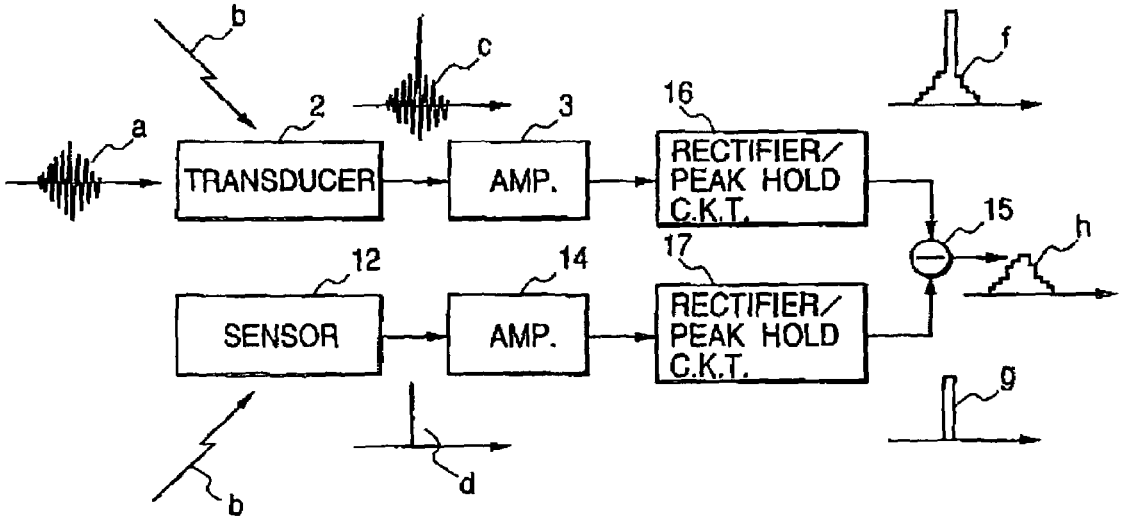
FIG. 7 is a block diagram which shows a sound collecting device according to the fifth embodiment of the invention.

FIG. 7 shows a sound collecting device according to the fifth embodiment of the invention which is different from the fourth embodiment only in that rectifier/peak hold circuits 16 and 17 are arranged between the amplifiers 3 and 14 and the subtactor 15. Other arrangements are identical, and explanation thereof in detail will be omitted here.

The rectifier/peak hold circuit 16 rectifies the composite signal c inputted through the amplifier 3 and holds a peak value of the rectified signal at given time intervals to produce a peak hold signal f. Similarly, the rectifier/peak hold circuit 17 rectifies the noise signal d inputted through the amplifier 14 and holds a peak value of the rectified signal at given time intervals to produce a peak hold signal g. The subtractor 15 subtracts the peak hold signal g from the peak hold signal f to produce an acoustic signal h corresponding to the sound wave a from which spike noises, instantaneous noises, and high-frequency noises are removed.

Figure 10:
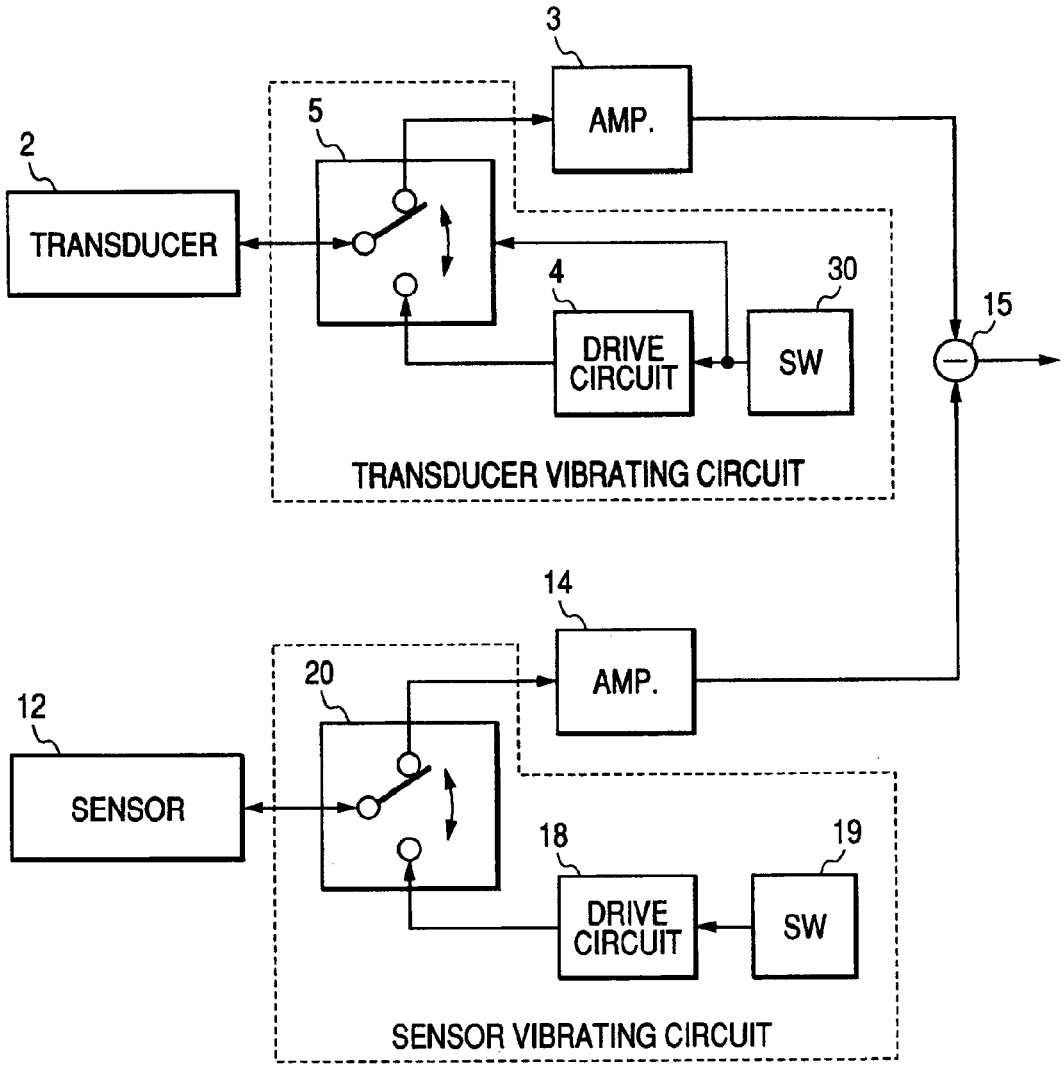
FIG. 10 is a block diagram which shows a sound collecting device according to a modification of the fourth embodiment of the invention.

In the fourth embodiment, as shown in FIG. 10, the drive circuit 14, the switch 5, the manual switch 30, and/or the controller 6, as shown in FIGS. 1 to 3, may be provided, like the first to third embodiments, to vibrate the transducer 2 for shaking foreign substances from the sensor 2. Additionally, a vibrating circuit equivalent to a combination of the drive circuit 18, a manual switch 19, and/or a switch 20 may also be connected to the electromagnetic sensor 12 for shaking foreign substances from the sensor1 2. In this case, a vibrating circuit may be controlled by the controller 6 in the same manner as discussed in the third embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A sound collecting device comprising:

a housing;

a sound collecting unit disposed within said housing;

a transducer, installed in said sound collecting unit, which receives both a sound wave and an electromagnetic wave and produces a composite signal denoting a mixture of the sound signal and the electromagnetic wave;

an electromagnetic sensor, installed in said housing adjacent to said sound collecting unit, which receives the electromagnetic wave to produce an electromagnetic signal denoting the electromagnetic wave;

a sensor amplifier which amplifies the electromagnetic signal produced by said electromagnetic sensor;

a transducer vibrating circuit, connected to said transducer in parallel to said sensor amplifier, which vibrates said transducer;

a sensor vibrating circuit, connected to said electromagnetic sensor in parallel to said sensor amplifier, which vibrates said electromagnetic sensor; and an output circuit which subtracts the electromagnetic signal produced by said electromagnetic sensor from the composite signal produced by said transducer to produce an acoustic signal corresponding to the sound signal.

2. A sound collecting device as set forth in claim 1, further comprising an opening formed in said housing for allowing the electromagnetic wave to enter said electromagnetic sensor from the same direction as that in which the sound wave enters said transducer.

3. A sound collecting device as set forth in claim 1, further comprising a first and a second peak hold circuit, the first peak hold circuit holding a peak of the output from said amplifier to provide a corresponding signal to said output circuit, the second peak hold circuit holding a peak of an output from said sensor amplifier to provide a corresponding signal to said output circuit.

4. A sound collecting device as set forth in claim 1, further comprising a first and a second switch, the first switch selectively establishing and blocking communications between said transducer and said amplifier and between said transducer and said transducer vibrating circuit, the second switch selectively establishing and blocking communications between said electromagnetic sensor and said sensor amplifier and between said electromagnetic sensor and said sensor vibrating circuit.

5. A sound collecting device as set forth in claim 1, further comprising a controller which controls an operation of said transducer vibrating circuit.

6. A sound collecting device as set forth in claim 5, further comprising a controller which controls switching operations of said first and second switches.

7. The sound collecting device as set forth in claim 1, further comprising:

a first amplifier amplifying the composite signal produced by said transducer;

a second amplifier amplifying the electromagnetic signal produced by said electromagnetic sensor, and wherein said output circuit is adapted to subtracts the electromagnetic signal amplified by said second amplifier from the composite signal amplified by said first amplifier to produce the acoustic signal.

8. The sound collecting device as set forth in claim 1, wherein said transducer is adapted to receive the sound wave transmitted along a sound wave direction, and said electromagnetic sensor is adapted to receive the electromagnetic wave transmitted along the same direction as the sound wave direction.

* * * * *